US008028476B1

(12) United States Patent
Alford

(10) Patent No.: US 8,028,476 B1
(45) Date of Patent: Oct. 4, 2011

(54) POOL LEVELING SYSTEM

(76) Inventor: Michael R. Alford, Dyersburg, TN (US)

( * ) Notice: Subject to any disclaimer, the term of this patent is extended or adjusted under 35 U.S.C. 154(b) by 724 days.

(21) Appl. No.: 11/262,571

(22) Filed: Oct. 31, 2005

Related U.S. Application Data

(60) Provisional application No. 60/635,287, filed on Dec. 13, 2004.

(51) Int. Cl.
*E04B 2/82* (2006.01)

(52) U.S. Cl. ..... 52/126.4; 52/169.7; 248/188.2

(58) Field of Classification Search ..... 52/169.7, 52/126.1, 126.4, 126.3, 126.6, 126.7; 248/188.4, 248/188.2, 188.8, 677; 249/2–8, 33–47, 249/208

See application file for complete search history.

(56) References Cited

U.S. PATENT DOCUMENTS

| | | | | | |
|---|---|---|---|---|---|
| 1,101,592 | A | * | 6/1914 | Wagner | 249/189 |
| 1,531,239 | A | * | 3/1925 | McCollum | 249/21 |
| 2,313,880 | A | * | 3/1943 | Leggett, Sr. | 249/27 |
| 2,596,976 | A | * | 10/1946 | Barber | 72/308 |
| 2,680,326 | A | * | 6/1954 | Sultan | 248/188.4 |
| 2,683,576 | A | * | 7/1954 | Miller | 248/562 |
| 3,059,243 | A | * | 10/1962 | Ross et al. | 4/512 |
| 3,067,843 | A | * | 12/1962 | Rushtoh et al. | 52/126.6 |
| 3,195,852 | A | | 7/1965 | Lundell | |
| 3,292,314 | A | * | 12/1966 | Heise | 52/79.5 |
| 3,411,252 | A | * | 11/1968 | Boyle, Jr. | 52/126.4 |
| 3,444,659 | A | * | 5/1969 | Vincent | 52/149 |
| 3,453,789 | A | * | 7/1969 | Stephenson | 52/126.3 |
| 3,497,881 | A | * | 3/1970 | Price | 5/310 |
| 3,533,586 | A | * | 10/1970 | Chichester, Jr. | 248/188.1 |
| 3,551,920 | A | * | 1/1971 | Greene | 52/149 |
| 3,600,722 | A | * | 8/1971 | Diemond et al. | 52/169.7 |
| 3,643,908 | A | * | 2/1972 | Laing | 249/27 |
| 3,704,560 | A | * | 12/1972 | Ratliff, Jr. | 52/126.7 |
| 3,817,006 | A | * | 6/1974 | Williams | 52/127.2 |
| 3,820,174 | A | * | 6/1974 | Rozanski | 52/169.7 |
| 3,885,361 | A | | 5/1975 | De Schutter | 52/122 |
| 3,906,688 | A | * | 9/1975 | Witte | 52/152 |
| 3,971,075 | A | * | 7/1976 | Heinbaugh et al. | 52/169.7 |
| 4,000,592 | A | * | 1/1977 | Kelly | 52/149 |
| 4,020,509 | A | * | 5/1977 | West | 52/169.7 |
| 4,044,514 | A | * | 8/1977 | Rubin et al. | 52/169.7 |
| 4,064,668 | A | * | 12/1977 | Carter | 52/295 |
| 4,068,427 | A | * | 1/1978 | Camardo | 52/127.2 |
| 4,077,173 | A | * | 3/1978 | Rozanski | 52/169.8 |

(Continued)

FOREIGN PATENT DOCUMENTS

JP 03002463 A * 1/1991

*Primary Examiner* — Eileen D Lillis
*Assistant Examiner* — James Ference
(74) *Attorney, Agent, or Firm* — Harness, Dickey & Pierce, P.L.C.

(57) ABSTRACT

A pool leveling system uses a threaded bolt that interacts with a support surface to alter the vertical alignment of the individual wall panels used to construct a modular swimming pool. The threaded bolt is coupled to the wall panels through a mounting bracket attached directly to a flange on the wall panel or indirectly through a frame used to support the wall panels. The mounting bracket is preferably a substantially C-shaped bracket having a hole adapted to receive the threaded bolt. The vertical alignment of the wall panels is adjusted by advancing or retracting the threaded bolt with respect to the mounting bracket. The mounting bracket and threaded bolt are left in place and encased in concrete when the pool installation is complete.

4 Claims, 8 Drawing Sheets

U.S. PATENT DOCUMENTS 4,101,111 A * 7/1978 Bishop ..... 249/205
4,124,907 A * 11/1978 Laven ..... 52/169.7
4,141,192 A 2/1979 Augustine ..... 52/749
4,202,083 A * 5/1980 Gutner ..... 29/897
4,397,441 A * 8/1983 Manderla ..... 249/19
4,413,453 A * 11/1983 Witte ..... 52/127.1
4,449,876 A * 5/1984 Glanton ..... 410/151
4,680,904 A * 7/1987 Stoecker ..... 52/169.12
4,787,183 A * 11/1988 Johnston ..... 52/126.4
4,825,605 A * 5/1989 Weir ..... 52/169.7
4,866,797 A * 9/1989 Vollan ..... 52/126.6
RE33,220 E * 5/1990 Collier ..... 52/263
4,996,770 A * 3/1991 McCracken ..... 29/897.34
5,069,418 A * 12/1991 Jennings ..... 249/210
5,076,536 A * 12/1991 Fitzgerald ..... 249/219.1
5,447,002 A * 9/1995 Wehrmann ..... 52/239
5,477,571 A * 12/1995 Roggenkamp et al. ..... 5/310
5,522,188 A * 6/1996 Cornelius ..... 52/169.8
5,542,219 A 8/1996 Dias ..... 52/126.4
5,560,576 A * 10/1996 Cargill ..... 248/231.61
5,561,950 A * 10/1996 Collins et al. ..... 52/126.6
5,664,380 A 9/1997 Hsueh ..... 52/126.4
5,666,769 A * 9/1997 Lundquist ..... 52/126.1
5,666,774 A * 9/1997 Commins ..... 52/298
5,794,912 A * 8/1998 Whittaker et al. ..... 248/638
5,817,247 A * 10/1998 Colatruglio ..... 249/4
5,843,327 A * 12/1998 Lindgren ..... 249/210
5,904,009 A * 5/1999 Huang ..... 52/126.6
5,956,906 A * 9/1999 Berich et al. ..... 52/149
6,062,545 A * 5/2000 Peavler ..... 254/418
6,205,719 B1 * 3/2001 Bruce ..... 52/147
6,230,448 B1 * 5/2001 Oliver et al. ..... 52/126.7
6,230,451 B1 * 5/2001 Stoller ..... 52/169.1
6,243,996 B1 * 6/2001 Oliver et al. ..... 52/126.1
6,256,939 B1 * 7/2001 Snyder ..... 52/126.6
6,336,892 B1 * 1/2002 Squibb ..... 482/23
6,655,097 B1 * 12/2003 Poolaw ..... 52/127.2
6,758,025 B2 * 7/2004 Haberler ..... 52/741.11
7,040,059 B2 * 5/2006 Hodsdon et al. ..... 52/127.2
7,051,988 B2 * 5/2006 Shaw et al. ..... 249/219.1
2002/0011549 A1 * 1/2002 Tkalec ..... 249/35
2004/0211127 A1 * 10/2004 Wiechecki et al. ..... 52/36.1
2005/0072059 A1 * 4/2005 Hodsdon et al. ..... 52/64
2005/0284042 A1 * 12/2005 Spedini ..... 52/169.7
2006/0124810 A1 * 6/2006 Cotto ..... 248/188.4

* cited by examiner

POOL LEVELING SYSTEM

CROSS-REFERENCES TO RELATED APPLICATIONS

The present application is based upon and claims priority from provisional patent application Ser. No. 60/635,287 filed Dec. 13, 2004 and disclosure document 563,955 filed Nov. 1, 2004.

FIELD OF THE INVENTION

The present invention generally relates to the installation of modular swimming pools having interconnected wall panels. More particularly, the present invention relates to a system for leveling the panels of a modular swimming pool during installation.

BACKGROUND OF THE INVENTION

Many modern swimming pools are constructed from a series of individual modules that are assembled on site to form the swimming pool. These modular swimming pools typically include modular wall panels that are designed to be attached to each other using bolts to thereby form the walls of the pool. The wall panels are typically constructed from a polymer, stainless steel, galvanized metal, or other suitable material. The panels are supported in a substantially upright orientation by a framework or series of braces connected to the outer face of the wall. Concrete is poured around the lower portions of the braces and the outer face of the wall panels to secure them in position and form the modular swimming pool's wall.

A modular swimming pool is typically installed by excavating a properly dimensioned hole in which the pool will be constructed. The wall panels are then positioned around the periphery of the excavated hole and bolted together to form the walls of the pool. The wall panels are vertically aligned or plumbed by adjusting the braces used to support the wall panels. Once the panels are connected and plumbed, the wall panels must be leveled with respect to horizontal to insure that the upper edge of the fully installed pool wall is horizontally level. The wall panels must be leveled prior to the pouring of the concrete collar around the pool since they will be fixed in position by the concrete. The wall panels are typically leveled by lifting the lower portions of the wall panels to the desired level and placing shims underneath the panels to hold them in position. Alternatively, some installers prepare the excavated surface first by placing and leveling patio blocks around its perimeter and then installing, leveling and shimming the pool on the prepared surface. Once the pool is plumb and level, the concrete collar is poured around the base of the panels and frames to secure the assembly in place.

Unfortunately, raising and leveling the wall panels of a modular swimming pool is a time consuming and imprecise process. Once a level position has been determined, the wall panels must be physically lifted and held in place while shims are placed underneath the panel to support it at the desired level. This is difficult in that the wall panels are often heavy and may drive the shims into the surrounding earth. This subsidence of the shims is especially troublesome if it occurs subsequent to the concrete being poured around the walls in that the concrete may need to be entirely removed to correct the problem. In addition, if the shims are not the right size, they must be cut or replaced with shims of the proper thickness. Thus, the installer must have shims of various sizes that can be combined to achieve the proper thickness. The repeated raising and lowering of the wall panels required when using such shims may also cause previously leveled panels to shift thereby requiring that they be re-leveled. Thus, a substantial amount of labor and effort are required to level the wall panels of a modular swimming pool in accordance with the prior art.

Therefore, what is needed is an improved method and apparatus for leveling the wall panels of a modular swimming pool during construction that requires less time and effort than prior art approaches.

BRIEF SUMMARY OF THE INVENTION

The purpose of the leveling system of the present invention is to level the panels of a modular swimming pool as precisely as possible and hold them at the proper level until a concrete collar has been poured.

An exemplary embodiment of the present invention is directed toward an apparatus for leveling a wall panel of a modular swimming pool. The system includes a mounting bracket for coupling a threaded shaft to the wall panel. Advancement or retraction of the threaded shaft with respect to the mounting bracket provides for vertical adjustment of the wall panel with respect to a support surface. The mounting bracket is either attached directly to the wall panel, to a side flange of the wall panel or to a frame member that is connected to the wall panel. The mounting bracket is preferably shaped like a clip. A nut provides a bearing surface for supporting the wall panel with respect to the threaded shaft.

Another exemplary embodiment of the present invention is directed toward a device for raising and lowering the wall panels of a modular swimming pool system during construction of a swimming pool. The device includes a panel leveling mechanism having a screw adjustment for coupling with a wall panel of the modular swimming pool. The panel leveling mechanism provides for vertical adjustment of the wall panel during construction of the pool. The wall panels include a frame assembly for supporting the wall panel in an upright fashion and the panel leveling means is coupled to the frame assembly with a mounting bracket. The mounting bracket is substantially clip shaped. The screw adjustment has a threaded shaft such that advancement or retraction of the threaded shaft with respect to the mounting bracket provides for vertical adjustment of the wall panel. A nut provides a bearing surface for use in supporting the wall panel with respect to the threaded shaft.

Yet another exemplary embodiment of the present invention is directed toward a structure for providing vertical adjustment of wall panels of a swimming pool assembly during installation. The structure includes an adjustment bolt adapted to contact a support surface for selectively altering a vertical alignment of at least one of the wall panels. A mounting bracket couples the adjustment bolt to the wall panels. The mounting bracket has two legs wherein at least one leg has an opening adapted to receive the adjustment bolt. The mounting bracket may be directly coupled to a flange on the wall panel or through a frame used to support said wall panel. The vertical alignment is then altered by advancing or retracting the adjustment bolt with respect to the mounting bracket.

BRIEF DESCRIPTION OF THE SEVERAL VIEWS OF THE DRAWINGS

FIG. 6(*b*) is a bottom view of the flanged area of a short angle;

FIG. 6(*c*) is a bottom view of a flanged area of a short angle with the clip;

FIG. 6(*d*) is a side view of a short angle with a threaded bolt and nut; and FIG. 6(*e*) is a top view of the of a short angle with a threaded bolt and nut.

DETAILED DESCRIPTION OF THE INVENTION

Figure 1:
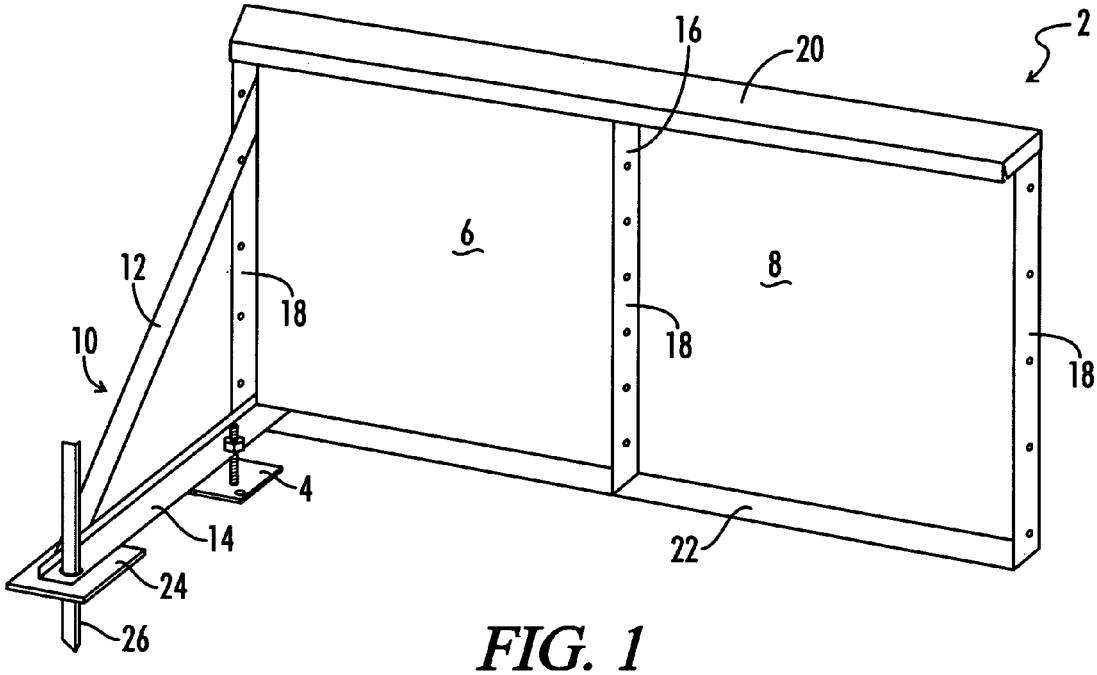
FIG. 1 is a three dimensional view of a panel leveling system for use with a modular swimming pool in accordance with an embodiment of the present invention.

Referring now to FIG. 1, a modular swimming pool wall section 2 utilizing a panel leveling mechanism 4 constructed in accordance with an embodiment of the present invention is shown. The modular swimming pool wall section 2 includes a wall panel 6 configured to connect to at least one other wall panel 8 along the adjoining edges 16 of the panels 6 and 8. The wall panels 6 and 8 are supported by a frame assembly 10 that typically includes a long angle 12 and a short angle 14 connected to an exterior side of the wall panels 6 and 8 to support them in a substantially upright position. The wall panels 6 and 8 also include side wall extensions 18 that extend along opposite edges of the panels 6 and 8 that are used to secure adjacent wall panels 6 and 8 together to form the swimming pool wall. The wall panels 6 and 8 also preferably include upper 20 and lower 22 extensions along the top and bottom edges of the panels 6 and 8 that serve to support the wall panel and facilitate connections thereto. The long angle 12 and short angle 14 of the frame assembly 10 are coupled at one end to the wall panel 6. Preferably, the short 14 and long 12 angle portions of the frame assembly 6 are bolted to the side wall extensions 18 of the wall panel 6 near the top and bottom of the panel 6. The long angle 12 is connected at its opposite end to the short angle 14 to extend as a diagonal strut between the panel 6 and the short angle 14. The long angle 12 typically has a variable length adjustment, as discussed in more detail with respect to FIGS. 3 and 4, to provide for adjustment in the upstanding orientation of the panel 6 (i.e. to "plumb" the panel 6 with respect to the adjacent panels). The frame assembly 10 includes a support plate 24 connected to the lower brace member 14 opposite the panel 6 to provide support bearing. The frame assembly 10 also includes a positioning stake 26 received through the support plate 24 which holds the plate 24 in position.

The modular swimming pool wall structure 2 of FIG. 1 includes a panel leveling system 4 that provides for selective vertical adjustment of the associated wall panels 6 and 8. The panel leveling system 4 is preferably attached to the short angle brace 14 at the junction between adjacent wall panels. The panel leveling system 4 includes a threaded bolt that works in connection with a support pad to lower or raise the associated wall panel 6. Thus, the panel leveling system 4 allows an installer to vertically adjust the individual wall panels 6 and 8 of a modular swimming pool to level the pool with respect to horizontal during installation.

Figure 2:
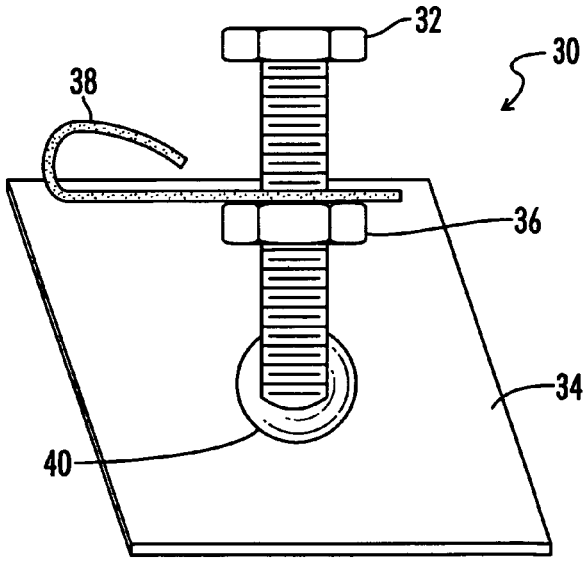
FIG. 2 is an illustration of an embodiment of the panel leveling system of the present invention.
Figure 5:
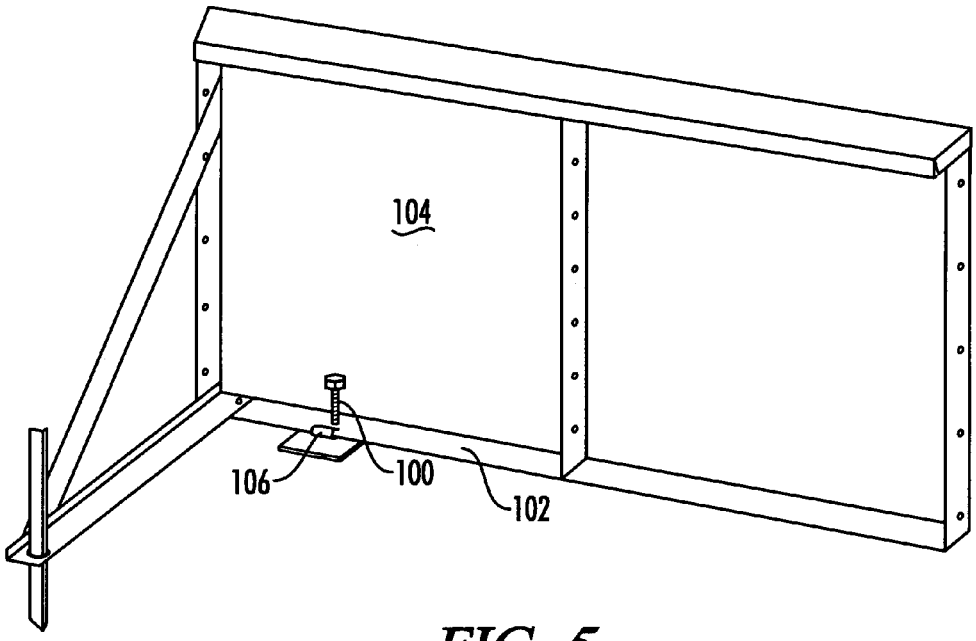
FIG. 5 is an illustration of a panel leveling mechanism coupled directly to a wall panel in accordance with an embodiment of the present invention.
Figure 6A:
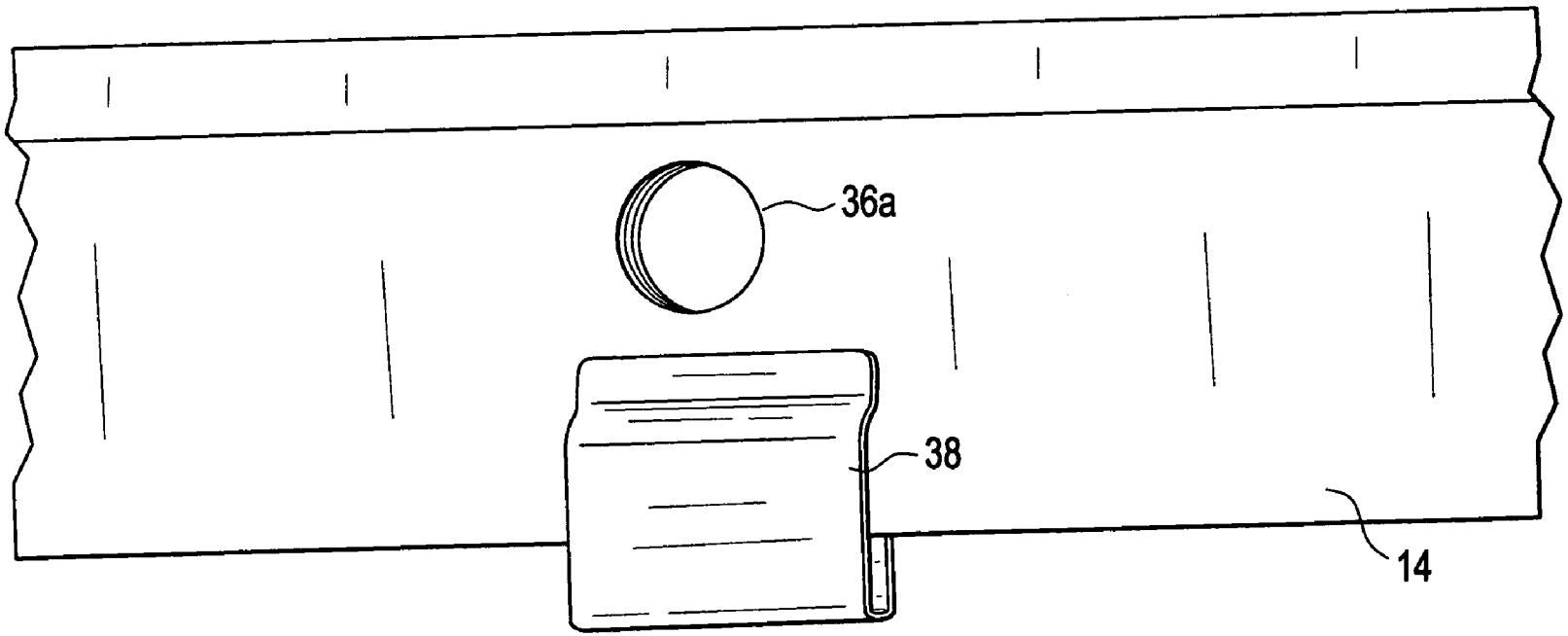
FIG. 6(*a*) is a top view of a flanged area of a short angle of one embodiment of the present invention.
Figure 6B:
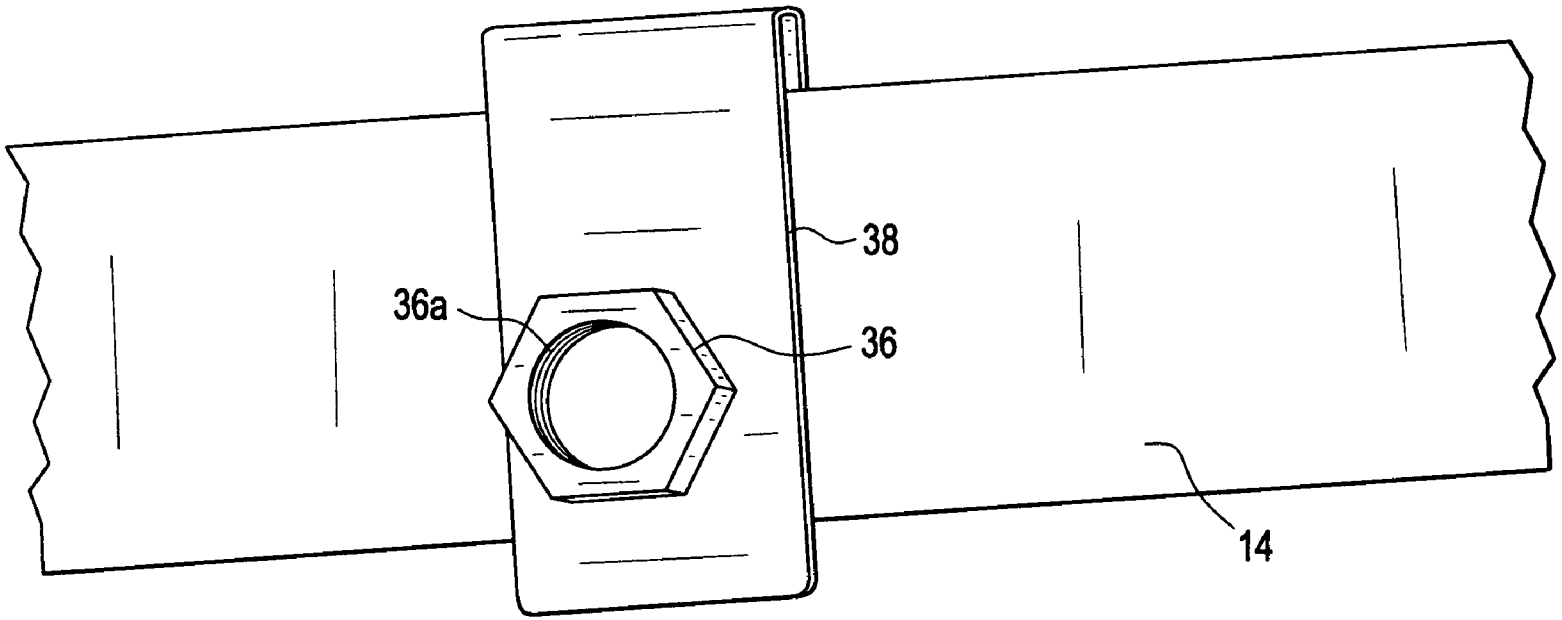
Figure 6C:
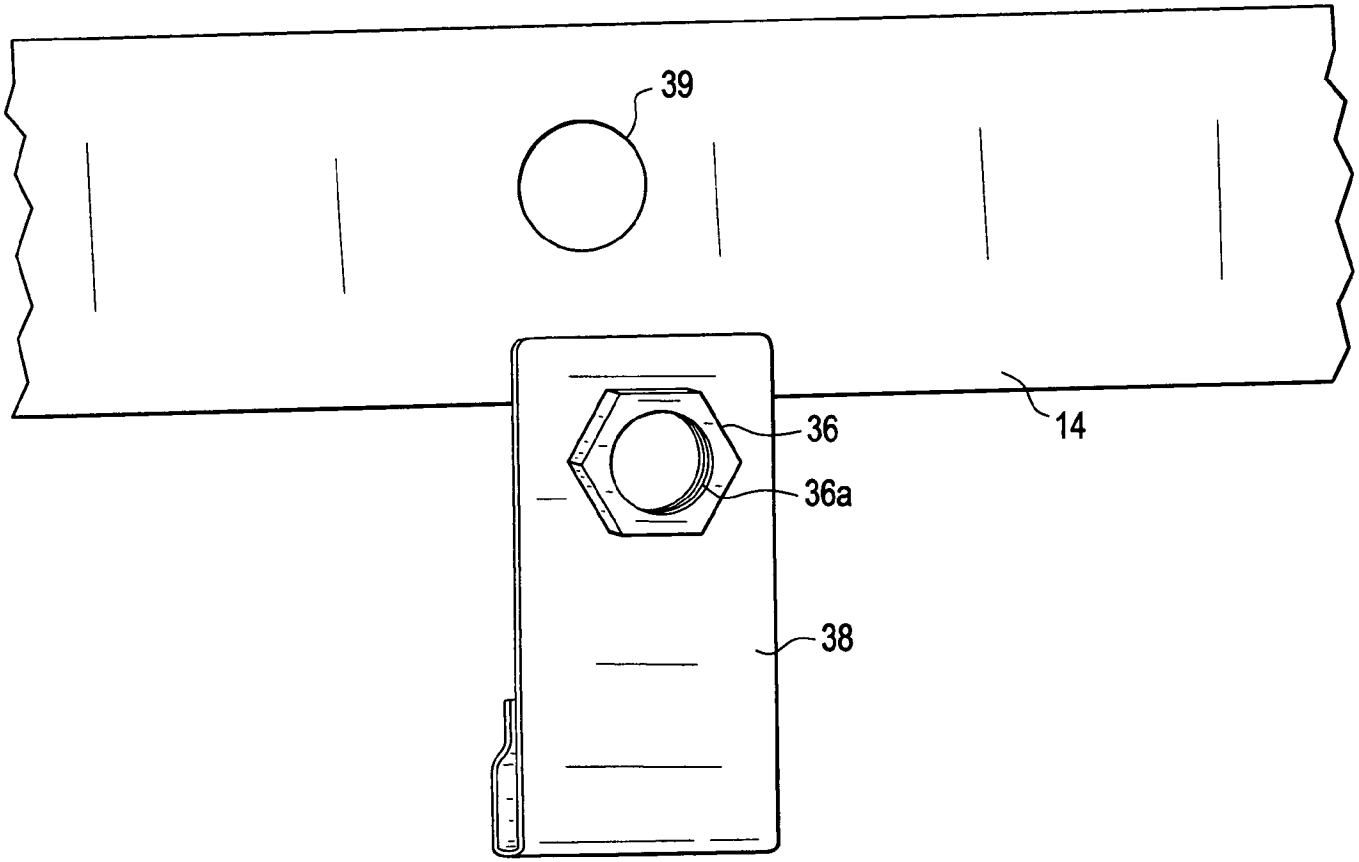
Figure 6D:
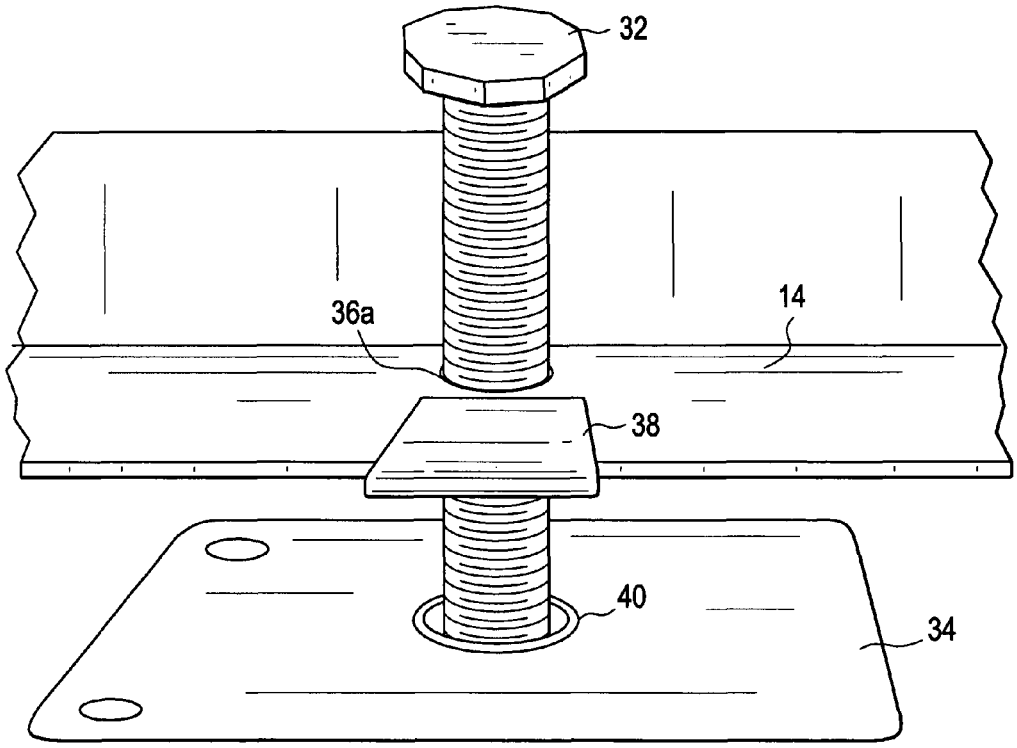
Figure 6E:
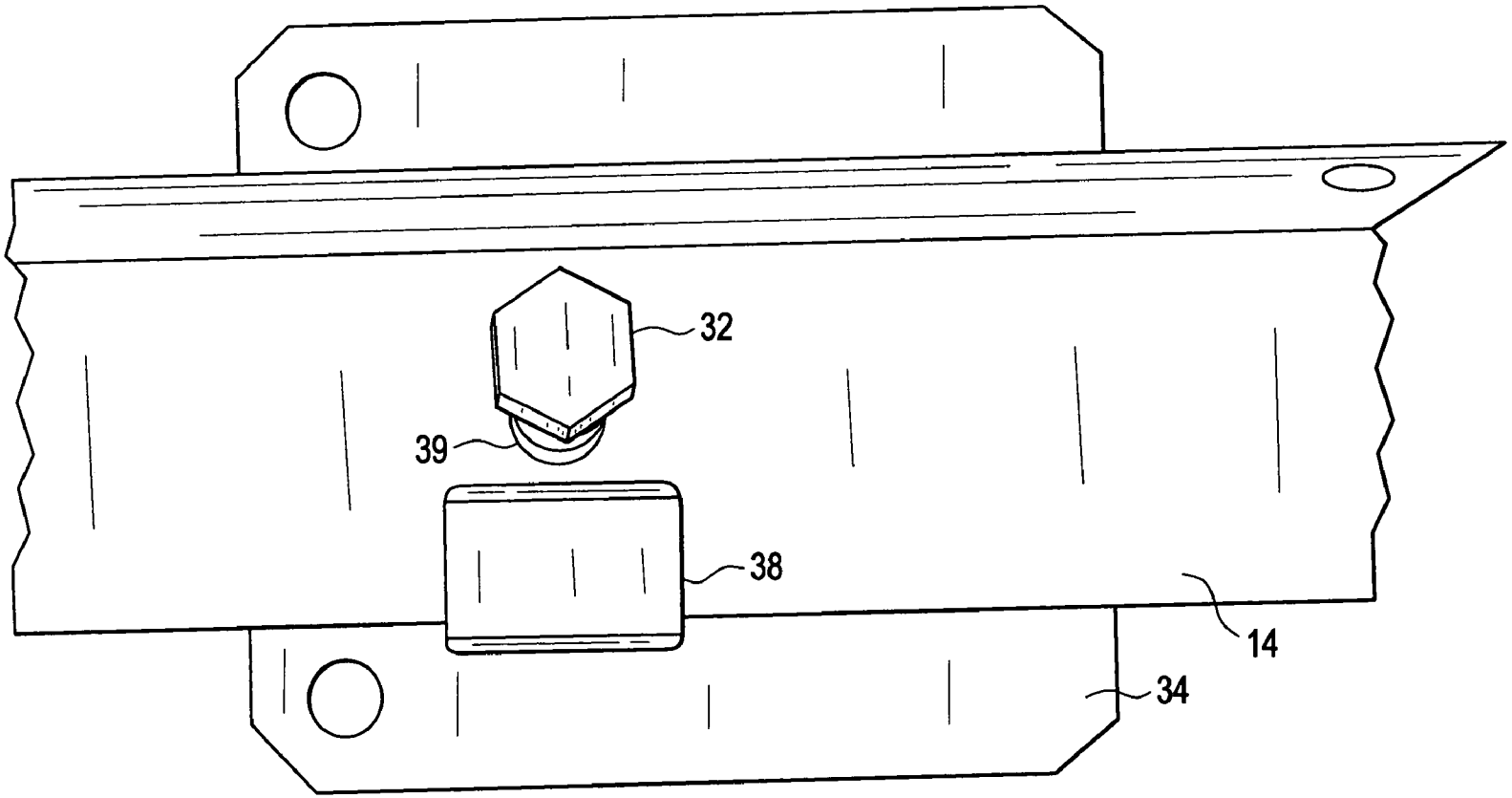

Referring now to FIG. 2, a detailed illustration of an embodiment of a panel leveling mechanism 30 constructed in accordance with an embodiment of the present invention is shown. The panel leveling mechanism 30 consists of a threaded bolt 32 positioned on a mounting plate 34. The threaded bolt 32 provides a lifting point for the wall panel 6 through contact between a terminal end of the bolt 32 and the mounting plate 34. The mounting plate 34 supports the weight of the wall panel 6 and prevents the lower end of the threaded bolt 32 from being pushed into the ground by the weight of the wall panel. The mounting plate 34 can vary in width and length depending upon the soil conditions. For example, soft sandy soils may require a larger plate 34, whereas a smaller, less expensive, plate 34 may be suitable for harder, rocky soils. A mounting pad 40 may be provided on the mounting plate 34 to prevent the lower end of threaded bolt 32 from sliding along the surface of the mounting plate 34. A clip 38 is coupled to a nut 36 that receives the threaded bolt 32. The clip 38 is preferably designed to be attached to the short angle 14 of the frame assembly 10 near the base of the wall panel 6 as shown in FIG. 1 or directly to the wall panel as shown in FIG. 5. Connecting the clip 38 to the short angle 14 is preferred because it allows the clip to be aligned with a pre-punched hole in the short angle and provides a solid base for the mounting plate 34 away from the bottom of the wall panel 6. In addition, the clip 38 can be attached to short angle of existing pool designs without requiring any in-house modifications to the existing designs other than the punching of the hole in the short angle. However, it will be readily appreciated by those skilled in the art that the clip 38 could easily be reconfigured to connect to any portion of the wall panel 6 desired. Once the clip 38 has been connected either directly or indirectly to the wall panel 6, the wall panel 6 may be raised or lowered by turning the threaded bolt 32 in either a clockwise or counter clockwise direction. Since turning the threaded bolt 32 in one complete circle only raises the wall panel 6 by a small amount, the magnitude of which is determined by the threading on the bolt 32, the threaded bolt 32 can be used to very precisely set the height of the wall panel 6.

Once the wall panels of the modular pool of the present invention have been leveled, the panel leveling mechanism of the present invention is preferably left in place such that it will be encased by the concrete used to surround the pool wall. This is economically feasible due to the relatively simple structure of the panel leveling mechanism and its correspondingly low unit cost. Alternatively, if desired, shims may be used to hold the pool walls at the desired level and the pool leveling systems removed for later use. However, leaving the pool levelers in place is preferred because it dramatically reduces the time and effort required to install the pool. In addition, if the panels are not properly leveled prior to the concrete being poured, the wet concrete can simply be raked away from the leveler and the level readjusted.

The present invention substantially lowers construction costs by reducing the number of individuals required to level the walls of a modular pool. Previously, two men were needed to lift the wall panel while a third individual positioned the proper amount and size of shims under the panel. With the preferred embodiment of the present invention, the pool leveler is simply inserted into a hole on the short angle and then ratcheted up to the proper level with a wrench. Thus, leveling the walls of a modular swimming pool using the pool levelers of the present invention only requires a single individual and a minimum amount of physical exertion. Thus, the labor costs associated with installing a modular pool are dramatically reduced.

Figure 3:
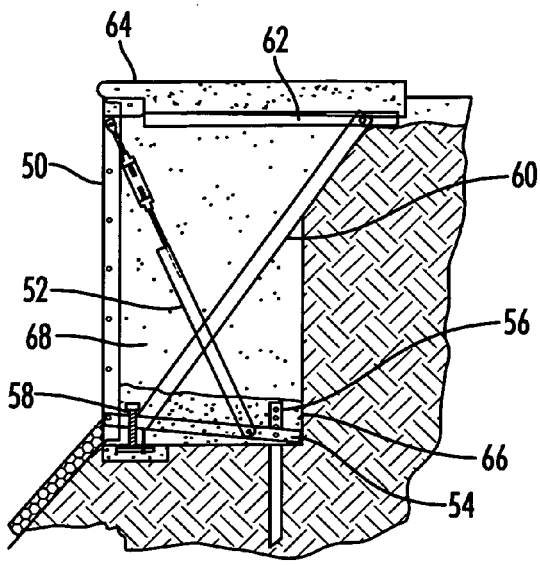
FIG. 3 is a side view illustration of an embodiment of the present invention incorporated into an installed modular swimming pool.

Referring now to FIG. 3, an embodiment 58 of the present invention incorporated into an installed modular pool structure is shown. The panel leveling mechanism 58 is easily incorporated into standard modular swimming pool without any modifications to the pool's existing design. The wall panel 50 of the modular swimming pool is supported by an adjustable length, long angle brace 52. The long angle brace 52 connects to a short angle brace 54 which is in turn connected to the base of the wall panel 50 and held in place by a stake 56, A second brace member 60 is connected at one end to the short angle brace 52 near the bottom of the wall panel 50 and at the other end to a deck brace angle 62 that supports a concrete pool deck 64. A pool leveling system 58 having a threaded bolt adjustment and support plate is connected to the short angle as discussed in more detail herein. The base of the pool leveling system 58 is surrounded by a concrete collar 66 which is in turn covered by a back fill material 68 such as gravel or sand.

Figure 4A:
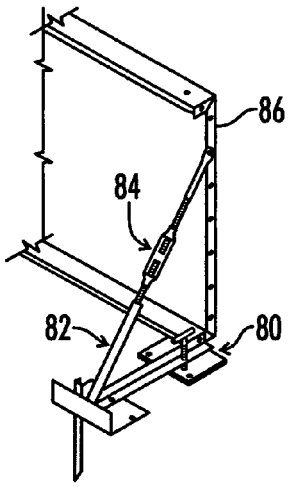
FIGS. 4(*a-c*) are illustrations of an embodiment of the panel leveling system of the present invention being used with different varieties of modular pools.
Figure 4B:
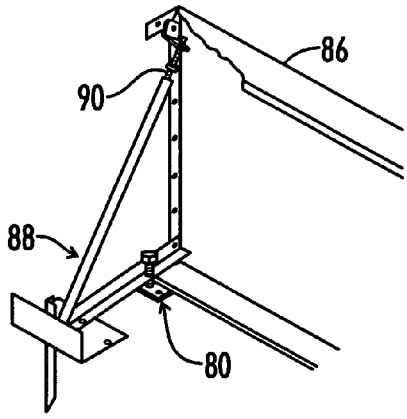
Figure 4C:
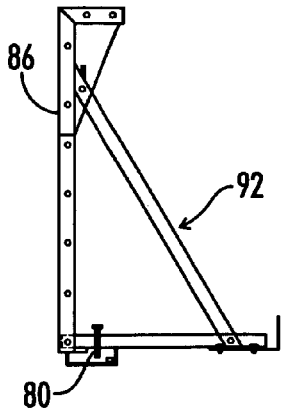

Referring now to FIGS. 4(*a*)-(*c*), embodiments of the present invention are shown incorporated into different types of modular pools. In FIG. 4(*a*), the panel leveling mechanism 80 is connected to the short angle of an A-frame support frame 82 having an adjustable turnbuckle 84 that supports the wall panel 86. In FIG. 4(*b*), the panel leveling mechanism 80 is connected to the short angle of an A-frame support frame 88 having a threaded bolt adjustment 90. In FIG. 4(*c*), the panel leveling mechanism 80 is connected to the short angle of an A-frame support frame 92 that does not have an adjustable long angle. Thus, embodiments of the present invention can be used in connection with all conventional types of modular swimming pools.

Referring now to FIG. 5, an alternative method of utilizing a panel leveling mechanism 100 in accordance with the present invention is shown. Like the panel leveling mechanism 80 of FIGS. 4(*a*)-(*c*), the mechanism 100 of FIG. 5 includes an adjustment bolt having a threaded shaft. However, instead of attaching to the frame assembly of the pool structure, the leveling mechanism 100 of FIG. 5 is attached directly to one of the side flanges 102 of an associated wall panel 104, preferably by bolting the bracket 106 to the side flange 102 of the wall panel 104 as shown. The panel leveling mechanism 100 functions in a manner similar to the panel leveling systems described herein by providing an adjustment support point through contact between the end of the bolt and a support surface. This arrangement is especially beneficial for use in connection with the vertical adjustment of a pool wall panel where there is no frame assembly. Such a frame assembly is often not used in connection with wall panels in the corner of a modular swimming pool.

FIGS. 6(*a*)-6(*e*) show an exemplary embodiment of the clip 38, nut 36 and short angle 14. FIG. 6(*a*) is a top view of a flanged area of the short angle illustrating the relative positions of the clip 38 on the flanged area of the short angle 14 with the clip 38 and nut 36 being aligned with a corresponding aperture 39 in the short angle 14 that receives the threaded bolt 32 (not shown). The bottom view of FIG. 6(*b*) shows an elongated planar area of the clip 38 engaging the flanged area of the short angle 14 with the threaded portion of the nut 36 aligned with a aperture 39 (or referred to as the pre-punched hole 39) for receiving the threaded bolt 32 (not shown). In the exemplary embodiment, the nut 36 is affixed to the clip 38 and is aligned with a corresponding aperture 38*a* in the clip 38 and pre-punched hole 39 in the short angle as shown in FIG. 6(*c*). The nut 36 may be affixed to the clip 38 by welding or other means to ensure alignment of the threaded portion 36*a* of the nut 36 with the pre-punched hole 39.

When assembled, the bolt 32 is inserted through the pre-punched hole in the short angle 14, engages the threaded portion of the nut 36, and passes through the corresponding aperture 38*a* in the clip 38 as shown in FIG. 6(*d*) and is advanced into engagement with a seated area of the plate 34 (also referred to as the mounting pad 40) in the mounting plate 34. The plate 34 is positioned on the ground, or other supporting surface, to receive the free end of the threaded bolt 32. As the bolt 32 is turned, the free end of the threaded bolt 32 engages the plate 34 causing a force to be communicated to the flanged area of the short angle 14 by the nut 36 and clip 38 thereby adjusting the height of the short angle 14 with respect to the ground or supporting surface. As shown in FIG. 6(*e*), the plate 34 is located below the flanged area of the short angle 14 in alignment with the clip 38 and pre-punched hole 39. In the examples shown, the plate 34 is planar shaped, but other shaped surfaces capable of supporting the threaded bolt 32 may be used.

Although there have been described particular embodiments of the present invention of a new and useful POOL LEVELING SYSTEM, it is not intended that such references be construed as limitations upon the scope of this invention except as set forth in the following claims.

What is claimed is:

1. An apparatus for use in constructing a modular swimming pool, said apparatus comprising:

a metallic pool wall panel;

an A-frame brace having a long angle member and a short angle member that couples to the metallic pool wall panel to support the metallic pool wall panel;

a threaded shaft; and a clip removably coupling said threaded shaft to a portion of said short angle member of said A-frame brace or said pool wall panel, wherein advancement or retraction of said threaded shaft provides for vertical lifting of said metallic pool wall panel with respect to a supporting surface;

a nut for providing a bearing surface for supporting said A-frame brace;

wherein said clip is coupled to said nut, said clip having a portion forming a groove receiving a flange of said short angle member;

wherein said clip and said nut receive said threaded shaft;

whereby rotation of said threaded member results in elevational adjustment of said clip, said nut and said short angle member.

2. The apparatus of claim 1 further comprising a mounting plate positioned on said supporting surface for supportingly receiving a lower end of said threaded shaft such that upward pressure can be applied to said metallic pool wall panel by an interaction between said lower end of said threaded shaft and said mounting plate wherein said mounting plate has an indentation formed therein for holding said threaded shaft in a fixed position with respect to said mounting plate.

3. The apparatus of claim 1 wherein said clip is substantially C-shaped.

4. The apparatus of claim 1 wherein the long angle member is connected to the short angle member and the clip is located between the metallic wall panel and the connection between the long angle member and the short angle member.

* * * * *